US007586268B2

(12) United States Patent
Gawrys et al.

(10) Patent No.: US 7,586,268 B2
(45) Date of Patent: Sep. 8, 2009

(54) APPARATUS AND METHOD FOR CONTROLLING THE FILAMENT VOLTAGE IN AN ELECTRONIC DIMMING BALLAST

(75) Inventors: Brent Gawrys, Whitehall, PA (US); Jecko J. Arakkal, Emmaus, PA (US); Mark S. Taipale, Harleysville, PA (US); Dragan Veskovic, Allentown, PA (US); Mark Charles Fischer, Siler City, NC (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 401 days.

(21) Appl. No.: 11/491,202

(22) Filed: Jul. 21, 2006

(65) Prior Publication Data

US 2007/0132401 A1 Jun. 14, 2007

Related U.S. Application Data

(60) Provisional application No. 60/748,861, filed on Dec. 9, 2005.

(51) Int. Cl.
*H05B 41/16* (2006.01)

(52) U.S. Cl. ..... 315/274; 315/224; 315/307; 315/312

(58) Field of Classification Search ..... 315/102–107, 315/205, 224–225, 247, 274–278, 291, 307, 315/360, DIG. 7, 312
See application file for complete search history.

(56) References Cited

U.S. PATENT DOCUMENTS 4,388,562 A * 6/1983 Josephson ..... 315/205
4,870,327 A * 9/1989 Jorgensen ..... 315/307
5,107,184 A 4/1992 Hu et al.
5,656,891 A * 8/1997 Luger et al. ..... 315/94
5,864,212 A 1/1999 Sullivan (Continued)

FOREIGN PATENT DOCUMENTS

EP 0 278 468 A2 8/1988

OTHER PUBLICATIONS

European Patent Office, International Search Report and Written Opinion, Mar. 26, 2007, 10 pages.

*Primary Examiner*—David Hung Vu
*Assistant Examiner*—Tung X Le
(74) *Attorney, Agent, or Firm*—Mark E. Rose; Philip N. Smith

(57) ABSTRACT

An electronic dimming ballast comprises a filament turn-off circuit for controlling the magnitudes of filament voltages supplied to the filaments of a gas discharge lamp. Each of a plurality of filament windings is directly coupled to one of the filaments and is operable to supply a small AC filament voltage to the filaments. The plurality of filament windings and a control winding are loosely magnetically coupled to a resonant inductor of an output circuit of the ballast. A controllably conductive device is coupled across the control winding. When the controllably conductive device is conductive, the voltage across the control winding and the filament windings falls to zero volts. The controllably conductive device is driven with a pulse-width modulated (PWM) signal so as to control the magnitudes of the filament voltages. The filament voltages are provided to the filaments before striking the lamp, and when dimming the lamp near low end.

62 Claims, 9 Drawing Sheets

U.S. PATENT DOCUMENTS 5,920,155 A * 7/1999 Kanda et al. ..... 315/307
5,923,126 A * 7/1999 Yang et al. ..... 315/102
5,973,455 A 10/1999 Mirskiy et al.
6,107,747 A * 8/2000 Hakuta et al. ..... 315/209 R
6,366,031 B2 4/2002 Klien
6,433,490 B2 8/2002 Koch et al.
6,501,225 B1 12/2002 Konopka
6,531,831 B2 3/2003 Chou et al.
6,664,742 B2 12/2003 Venkatraman et al.
6,750,619 B2 * 6/2004 Nemirow et al. ..... 315/291
7,187,132 B2 3/2007 Bakre
7,247,991 B2 7/2007 Chen et al.

* cited by examiner

APPARATUS AND METHOD FOR CONTROLLING THE FILAMENT VOLTAGE IN AN ELECTRONIC DIMMING BALLAST

RELATED APPLICATIONS

This application claims priority from commonly-assigned U.S. Provisional Patent Application Ser. No. 60/748,861, filed Dec. 9, 2005, entitled APPARATUS AND METHOD FOR CONTROLLING THE FILAMENT VOLTAGE IN AN ELECTRONIC DIMMING BALLAST, the entire disclosure of which is hereby incorporated by reference.

BACKGROUND OF THE INVENTION

1. Field of the Invention

The present invention relates to electronic ballasts and, more particularly, to electronic dimming ballasts for gas discharge lamps, such as fluorescent lamps.

2. Description of the Related Art

The typical fluorescent lamp is a sealed glass tube with a rare earth gas and has an electrode at each end for striking and maintaining an electric arc through the gas. The electrodes are typically constructed as filaments to which a filament voltage is applied to heat the electrodes, thereby improving their capability to emit electrons. This results in improved electric arc stability and longer lamp life.

Typical prior art ballasts apply the filament voltages to the filaments prior to striking the arc, and maintain the filament voltages throughout the entire dimming range of the lamp. At low end, when light levels are lowest and, consequently, the electric arc is at its lowest level, the filament voltages are essential for maintaining a stable arc current. However, at high end, when light levels are highest, and the electric arc current is at its highest level, the electric arc current contributes to heating the filaments. Consequently, the filament voltages are not essential for proper operation of the lamp at high end, and may be dispensed with. At high end, the filament voltages do not provide any benefit in maintaining the electric arc, and result in excessive power consumption and unwanted heat.

An example of a prior art electronic dimming ballast 100 for driving three fluorescent lamps L1, L2, L3 in parallel is shown in FIG. 1. Electronic ballasts typically can be analyzed as comprising a front end 110 and a back end 120. The front end 110 typically includes a rectifier 130 for generating a rectified voltage from an alternating-current (AC) mains line voltage, and a filter circuit, for example, a valley-fill circuit 140, for filtering the rectified voltage to produce a direct-current (DC) bus voltage. The valley-fill circuit 140 is coupled to the rectifier 130 through a diode 142 and includes one or more energy storage devices that selectively charge and discharge so as to fill the valleys between successive rectified voltage peaks to produce a substantially DC bus voltage. The DC bus voltage is the greater of either the rectified voltage or the voltage across the energy storage devices in the valley-fill circuit 140.

The back end 120 typically includes an inverter 150 for converting the DC bus voltage to a high-frequency AC voltage and an output circuit 160 comprising a resonant tank circuit for coupling the high-frequency AC voltage to the lamp electrodes. A balancing circuit 170 is provided in series with the three lamps L1, L2, L3 to balance the currents through the lamps and to prevent any lamp from shining brighter or dimmer than the other lamps. A control circuit 180 generates drive signals to control the operation of the inverter 150 so as to provide a desired load current to the lamps L1, L2, L3. A power supply 182 is connected across the outputs of the rectifier 130 to provide a DC supply voltage, $V_{CC}$, which is used to power the control circuit 180.

FIG. 2 shows a simplified schematic diagram of the back end 120 of a prior art dimming ballast for driving the lamps L1, L2, L3 in parallel. As previously mentioned, the back end 120 includes the inverter 150 and the output circuit 160. The inverter input terminals A, B are connected to the output of the valley-fill circuit 140. The inverter 150 provides the high-frequency AC voltage for driving the lamps L1, L2, L3 and includes series-connected first and second switching devices 252, 254, for example, two field effect transistors (FETs). The control circuit 170 drives the FETs 252, 254 of the inverter using a complementary duty cycle switching mode of operation. This means that one, and only one, of the FETs 252, 254 is conducting at a given time. When the FET 252 is conducting, then the output of the inverter 150 is pulled upwardly toward the DC bus voltage. When the FET 254 is conducting, then the output of the inverter 150 is pulled downwardly toward circuit common.

The output of the inverter 150 is connected to the output circuit 160 comprising a resonant inductor 262 and a resonant capacitor 264. The output circuit 160 filters the output of the inverter 150 to supply an essentially sinusoidal voltage to the parallel-connected lamps L1, L2, L3. A DC blocking capacitor 266 prevents DC current from flowing through the lamps L1, L2, L3.

Filament windings W1, W2, W3, W4 are magnetically coupled to the resonant inductor 262 of the output circuit 160 and are directly coupled to the filaments of lamps L1, L2, L3. Because the lamps are being driven in parallel in FIG. 2, the windings W1, W2, W3 are each provided to the filaments of different lamps and winding W4 is provided to the filaments of all three lamps L1, L2, L3. The filament windings provide AC filament voltages, having magnitudes of approximately 3-5 $V_{RMS}$, to the filaments to keep the filaments warm through the entire dimming range. The filaments especially need to be heated when the ballast is dimming the lamps to low end and during preheating of the filaments before striking the lamp. However, the prior art ballast 100 constantly provides the filament voltages to the filaments, which increases the power consumption of the ballast.

Some prior art ballasts provide the filament voltages to the filaments of the lamps before striking the lamps, but then cuts off the filament voltages in order to reduce the power consumed by the ballast during normal operation. An example of such a ballast is described in greater detail in U.S. Pat. No. 5,973,455 to Mirskiy et al., issued Oct. 26, 1999, entitled ELECTRONIC BALLAST WITH FILAMENT CUT-OUT, the entire disclosure of which is incorporated herein by reference. The ballast includes an AC switch having a diode bridge defining two AC terminals and two DC terminals and having a transistor connected across the DC terminals. The primary winding of a filament transformer is connected across the AC terminals of the bridge. The transistor is coupled to a microprocessor for controlling the current through the primary winding of the filament transformer. The microprocessor is programmed to close the AC switch while the lamps are starting and to open the switch after the lamps are started, thereby cutting off the filament voltages from the lamps.

However, in order to control the filament voltages, the ballast of Mirskiy et al. requires two magnetics: a first magnetic for coupling to the source of AC power and the second magnetic for coupling to the filaments. The requirement of two magnetics adds cost and requires control space in the ballast. Further, the ballast of Mirskiy et al. is only operable to turn off the filament voltage after the lamps have been struck and does not allow for control of the filament voltage throughout the dimming range of the ballast. Because of this, the ballast does not allow for a reduced power dissipation throughout the dimming range of the ballast.

Thus, there exists a need for a ballast back end circuit that is operable to control the filament voltages provided to the filaments of the lamps that requires fewer parts, in particular, fewer magnetics. Also, there exists a need for a method of controlling the back end of a ballast in order to control the magnitude of the filament voltages provided to the filaments of the lamps throughout the dimming range of the ballast.

SUMMARY OF THE INVENTION

According to the present invention, an electronic dimming ballast for driving a gas-discharge lamp having a plurality of filaments includes an output circuit operable to receive a high-frequency AC voltage. The ballast further comprises a plurality of filament windings magnetically coupled to an inductor of the output circuit. Each filament winding is connectable to one of the filaments of the lamp and operable to supply a small AC filament voltage to one of the plurality of filaments. The ballast further comprises a control winding magnetically coupled to the inductor. A controllably conductive device having a control input is coupled such that the controllably conductive device is operable to control a voltage across the control winding. A control circuit is coupled to the control input of the controllably conductive device and is operable to render the controllably conductive device conductive and non-conductive. When the controllably conductive device is non-conductive, the plurality of AC filament voltages each have a first magnitude. When the controllably conductive device is conductive, the plurality of AC filament voltages each have a second magnitude. In a preferred embodiment of the present invention, the controllably conductive device comprises a semiconductor switch coupled across the control winding. In addition, the second magnitude is preferably less than the first magnitude and substantially zero volts. Further, the control circuit is operable to drive the control input of the controllably conductive device with a pulse-width modulated (PWM) signal to control the magnitudes of the filament voltages.

According to another embodiment of the present invention, an electronic ballast for driving a gas discharge lamp having a plurality of filaments comprises an output circuit operable to receive a high-frequency AC voltage, a plurality of filament windings, a filament turn-off circuit, and a control circuit. Each of the plurality of filament windings is connectable to one of the plurality of filaments of the lamp and operable to supply a small AC filament voltage to one of the plurality of filaments. The control circuit is operable to drive the filament turn-off circuit with a pulse-width modulated signal having a variable duty cycle to control the magnitude of each of the plurality of AC filament voltages.

In addition, the present invention provides a circuit for an electronic ballast for controlling a plurality of AC filament voltages provided to a plurality of filaments of a gas discharge lamp. The circuit comprises a plurality of filament windings, a control winding, a controllably conductive device, and a control circuit. The plurality of filament windings and the control winding are magnetically coupled to a resonant inductor of the ballast. Each of the plurality of filament windings is operable to be connected to, and to provide a filament voltage to, one of the plurality of filaments of the lamp. The controllably conductive device has a control input and is coupled such that the controllably conductive device is operable to control a voltage across the control winding. The control circuit is coupled to the control input of the controllably conductive device and is operable to render the controllably conductive device conductive and non-conductive. Accordingly, when the controllably conductive device is non-conductive, the plurality of AC filament voltages each have a nominal magnitude, and when the controllably conductive device is conductive, the plurality of AC filament voltages each have a magnitude substantially less than the nominal magnitude.

The present invention further provides a method for controlling a plurality of AC filament voltages provided to a plurality of filaments of a gas discharge lamp in an electronic ballast comprising an output circuit including an inductor. The method comprises the steps of magnetically coupling a plurality of filament windings to the inductor, connecting each of the filament windings to one of the plurality of filaments of the lamp, providing each of the plurality of AC filament voltages to one of the plurality of filaments, magnetically coupling a control winding to the inductor, and controlling a voltage across the control winding to control a magnitude of each of the plurality of AC filament voltages. In a preferred embodiment, the step of controlling a voltage across the control winding comprises the steps of coupling a controllably conductive device having a control input across the control winding such that the controllably conductive device is operable to control the voltage across the control winding, and controlling the controllably conductive device such that when the controllably conductive device is non-conductive, each of the plurality of AC filament voltages has a first magnitude, and when the controllably conductive device is conductive, each of the plurality of AC filament voltages has a second magnitude.

According to another aspect of the present invention, a method for controlling a plurality of AC filament voltages provided to a plurality of filaments of a gas discharge lamp in an electronic ballast comprising an output circuit including an inductor comprises the steps of connecting each of the filament windings to one of the plurality of filaments of the lamp, providing each of the plurality of AC filament voltages to one of the plurality of filaments, coupling a filament turn-off circuit comprising a controllably conductive device to the output circuit, and driving the controllably conductive device with a pulse-width modulated signal to control the magnitude of each of the plurality of AC filament voltages.

Other features and advantages of the present invention will become apparent from the following description of the invention that refers to the accompanying drawings.

DETAILED DESCRIPTION OF THE INVENTION

Figure 1:
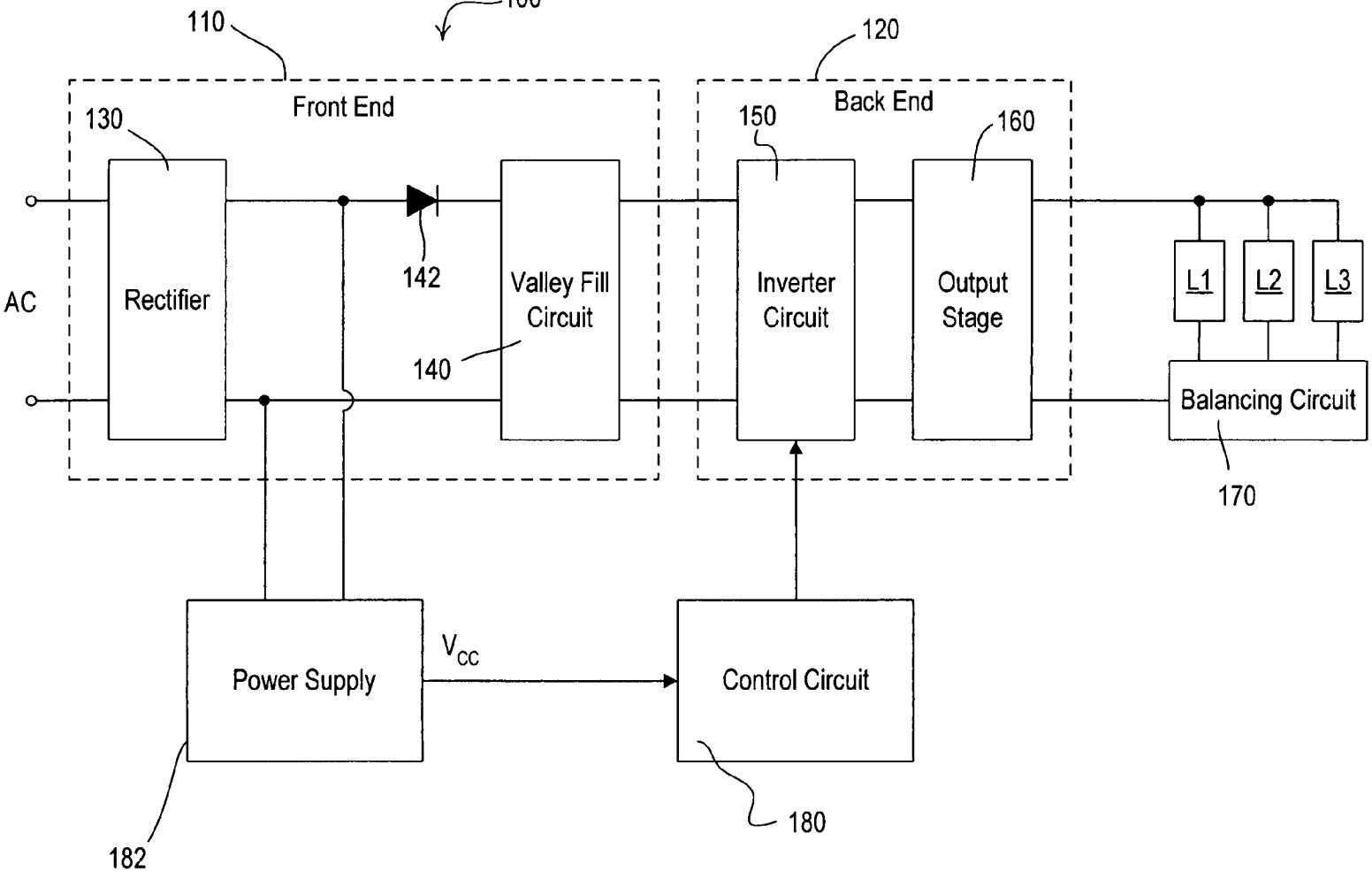
FIG. 1 PRIOR ART
FIG. 1 is a simplified block diagram of a prior art dimming ballast.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 3:
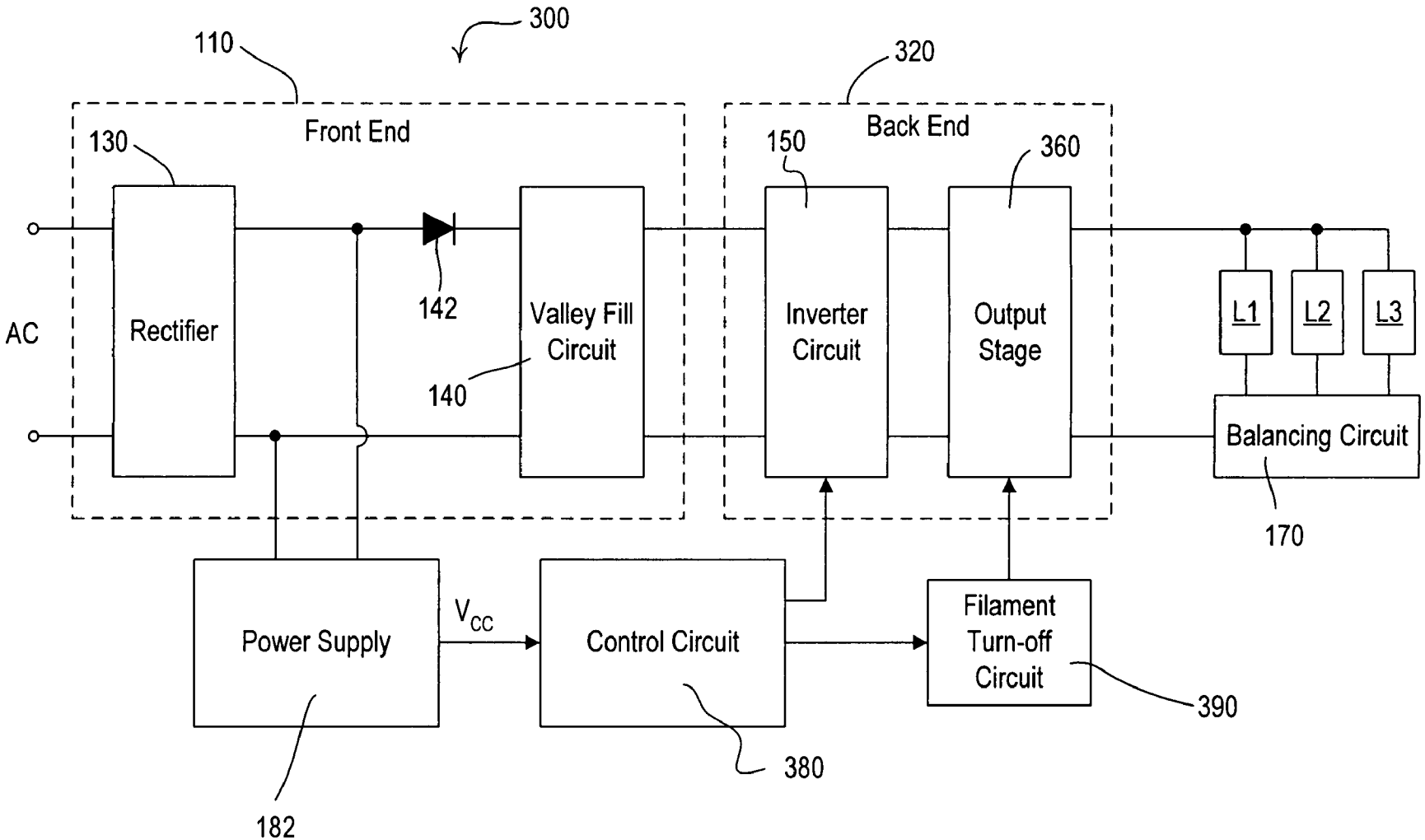
FIG. 3 is a simplified block diagram of a ballast according to the present invention.

Turning first to FIG. 3, there is shown a simplified block diagram of an electronic dimming ballast 300 according to the present invention. The ballast 300 includes many similar blocks as the prior art ballast 100 of FIG. 1, which have the same function as described previously. However, those components of the ballast 300 that differ from the prior art ballast 100 will be described in greater detail below.

The ballast 300 comprises a back end 320 that includes an output stage 360 according to the present invention. A control circuit 380 provides a control signal to a filament turn-off circuit 390 to control when the filament voltages are provided to the lamps L1, L2, L3 and to control the magnitude of the filament voltages. The filament turn-off circuit 390 accordingly controls the output circuit 360 in response to the control signal from the control circuit 380. The control circuit 380 may comprise an analog circuit or any suitable processing device, such as a programmable logic device (PLD), a microcontroller, a microprocessor, or an application specific integrated circuit (ASIC).

Figure 2:
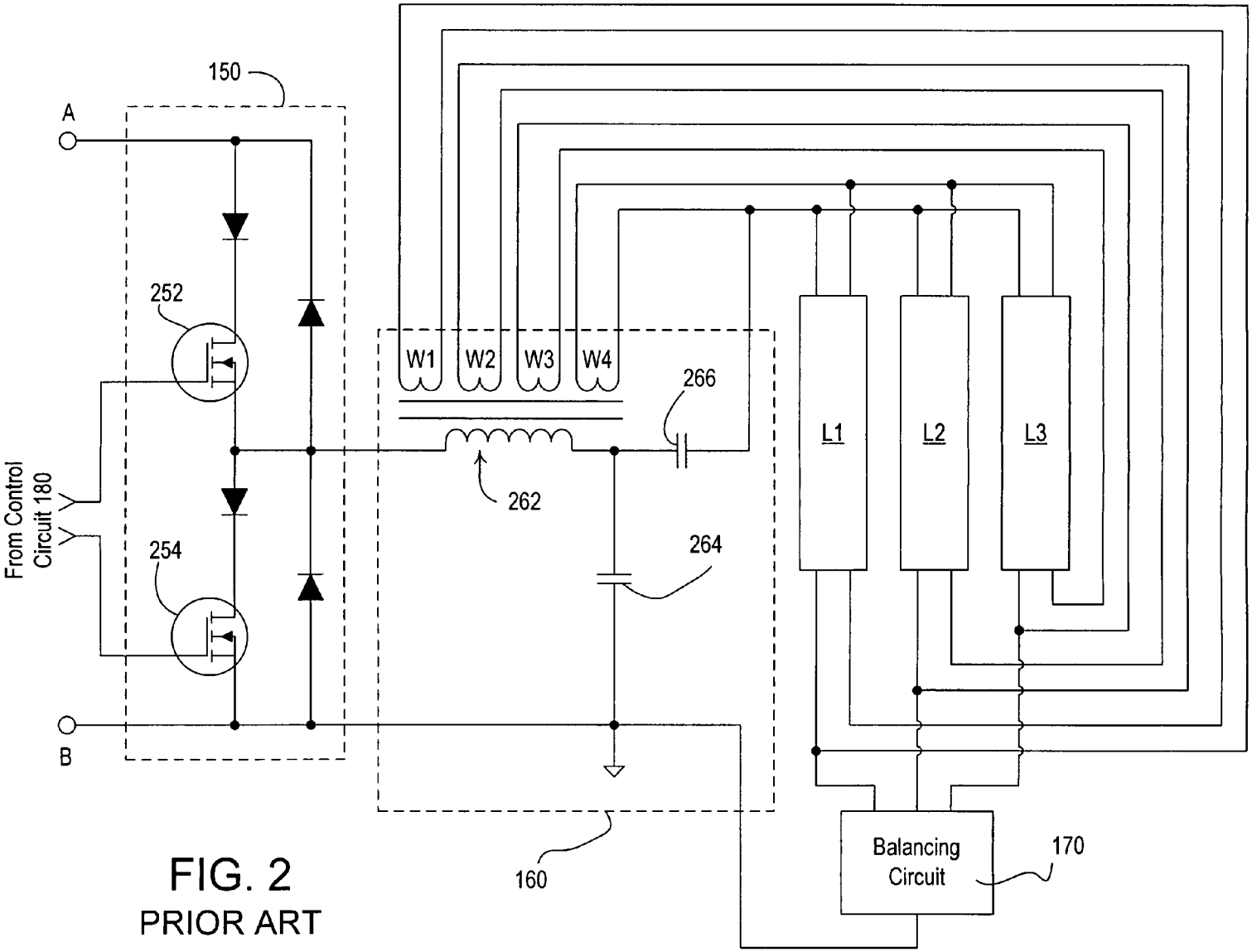
FIG. 2 PRIOR ART
FIG. 2 is a simplified schematic diagram of the back end of the prior art dimming ballast of FIG. 1 for driving multiple lamps in parallel.
Figure 4:
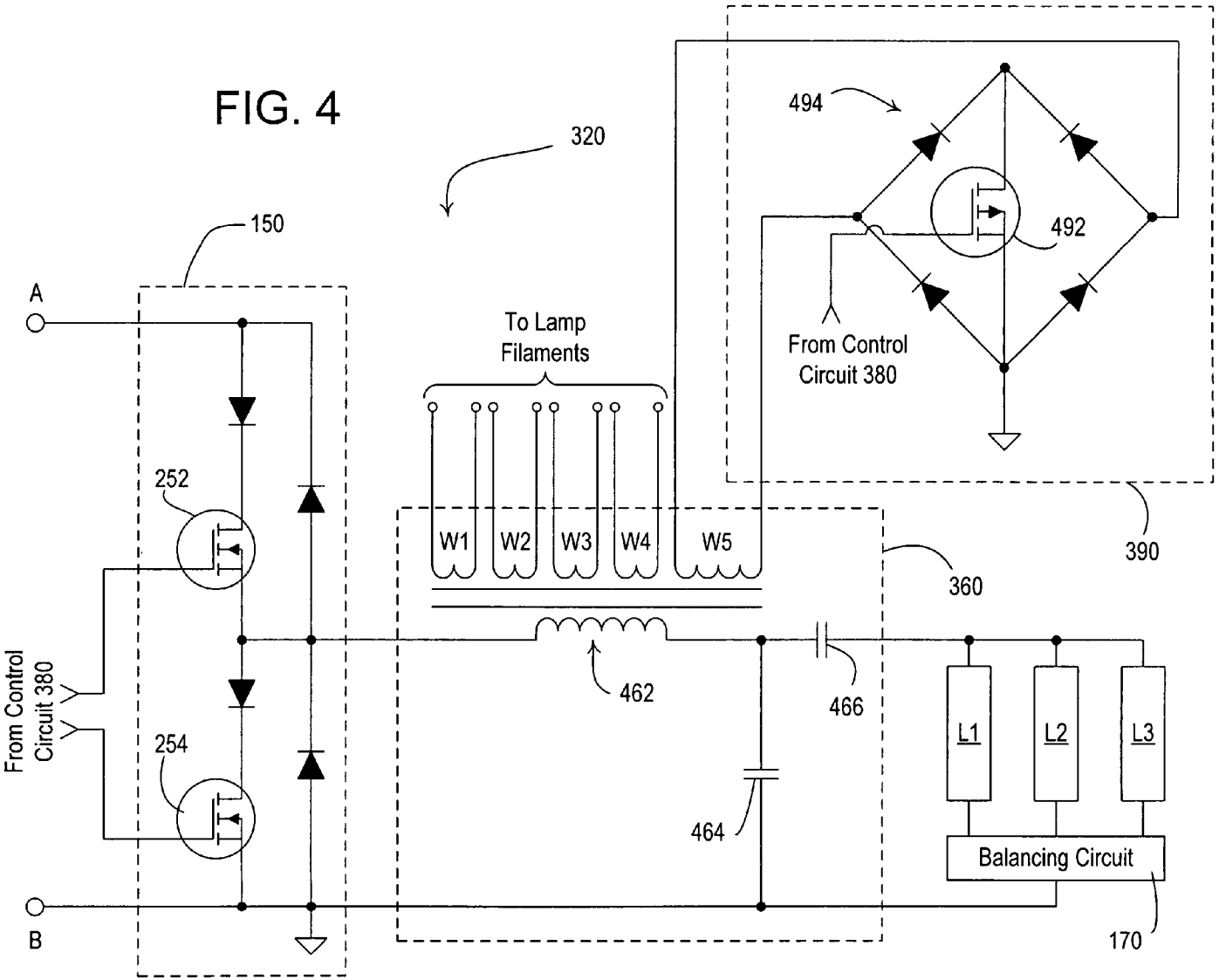
FIG. 4 is a simplified schematic diagram of a ballast back end comprising a filament turn-off circuit according to a first embodiment of the present invention.

Referring to FIG. 4, there is shown a simplified schematic diagram of the back end 320 of the ballast 300 according to a first embodiment of the present invention. The output circuit 360 includes a resonant inductor 462, a resonant capacitor 464, and a DC blocking capacitor 466. The lamps L1, L2, L3 and the balancing circuit 170 are coupled across the resonant capacitor 464. The filament windings W1, W2, W3, W4 are magnetically coupled to the resonant inductor 462 and directly coupled to the lamps L1, L2, L3 to provide the filament voltages to the lamps (in the same manner as shown in FIG. 2). A control winding W5 is also magnetically coupled to the resonant inductor 462.

Note that all windings W1, W2, W3, W4, W5 are loosely coupled to the resonant inductor 462, such that if any of the windings are electrically shorted, the inductance of the resonant inductor is not greatly affected. For example, if the nominal inductance of the resonant inductor 462 is 470 μH, the inductance preferably shifts no more than approximately 30 μH—to 440 μH—when the control winding W5 is shorted. This approximately 6.4% change in inductance does not significantly alter the inductance of the resonant inductor 462 or the operation of the output circuit 360.

Figure 5C:
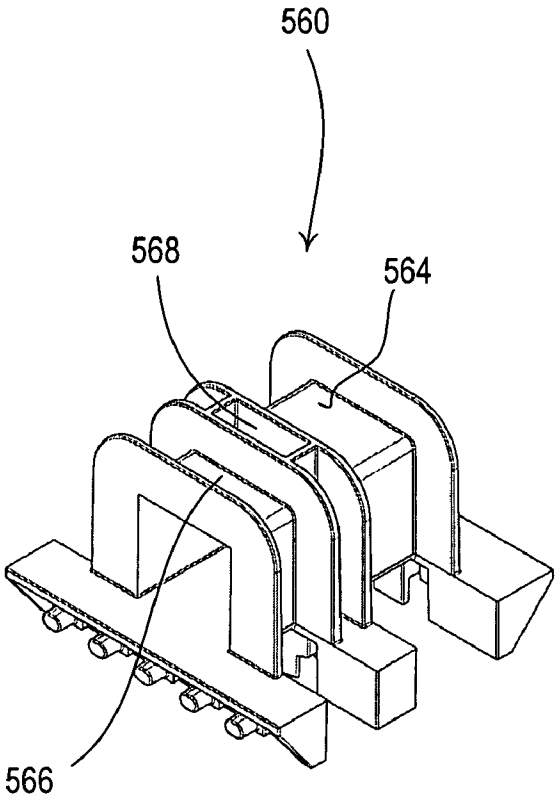
FIG. 5C is a perspective view of the bobbin of FIG. 5A without the ferrite core installed.
Figure 5B:
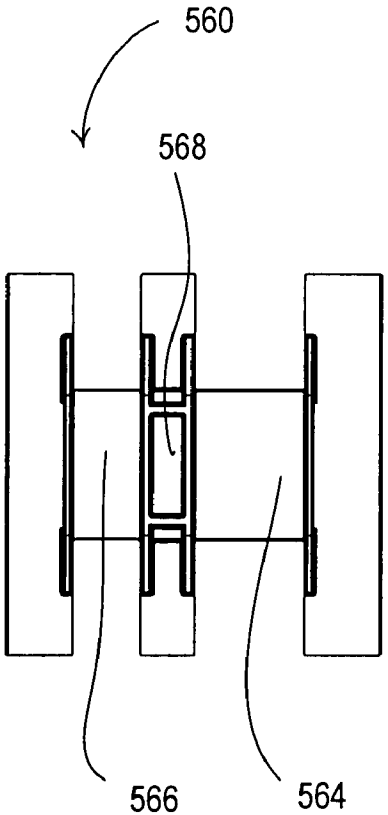
FIG. 5B is a top view of the bobbin of FIG. 5A without the ferrite core installed.
Figure 5A:
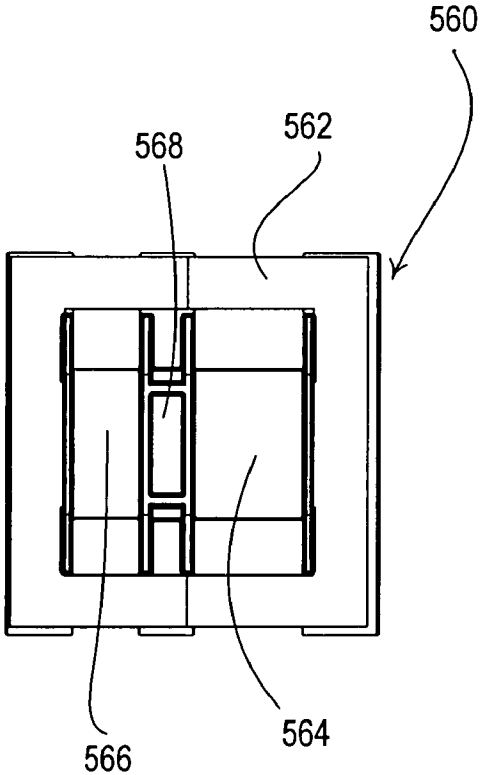
FIG. 5A is a top view of a bobbin of the ballast back end of FIG. 4 with a ferrite core installed.

Preferably, the resonant inductor 462, the filament windings W1, W2, W3, W4, and the control winding W5 are wound on a single bobbin 560. FIG. 5A is a top view of the bobbin 560 with a ferrite core 562 installed. FIG. 5B is a top view and FIG. 5C is a perspective view of the bobbin 560 without the ferrite core 562 installed. The bobbin 560 comprises a first bay 564 around which the wire (not shown) of the resonant inductor 462 is wound. The windings W1, W2, W3, W4, W5 (not shown in FIGS. 5A-5C) are all wound in a second bay 566. The bobbin 560 comprises a spacing 568 between the first bay 564 and the second bay 566. The spacing 568 allows the windings W1, W2, W3, W4, W5 to be loosely magnetically coupled to the resonant inductor 462.

Referring back to FIG. 4, the filament voltage turn-off circuit 390 is coupled across the control winding W5 and includes a controllably conductive device, for example, a FET 492 in a full-wave rectifier bridge 494, which comprises four diodes. Alternatively, the filament voltage turn-off circuit may be a relay or any type of bidirectional semiconductor switch, such as two FETs in anti-series connection. Also alternatively, the controllably conductive device may be a bipolar junction transistor (BJT), an insulated gate bipolar transistor (IGBT), or some such similar controllable switching device. The FET 492 has a control input that is coupled to the control circuit 380 and is utilized to render the FET conductive or non-conductive. When the FET 492 is non-conductive, current is not able to flow through the control winding W5. This allows the filament windings W1, W2, W3, W4 to operate normally and to provide the filament voltages to the filaments of the lamps L1, L2, L3 in the same manner as the prior art ballast 100. However, when the FET 492 is conductive, the filament voltage turn-off circuit 390 essentially electrically shorts out the control winding W5, i.e., the voltage across the control winding W5 is substantially zero volts. This in turn collapses the filament voltages across windings W1, W2, W3, W4 to substantially low voltages, e.g., preferably substantially zero volts. Since the windings are loosely coupled to the resonant inductor 462, this operation does not significantly affect the inductance of the resonant inductor 462 and the operation of the ballast 300.

As previously mentioned, the filaments of the lamps L1, L2, L3 need to be heated prior to striking the lamps and when dimming to a low light intensity. To strike the lamps L1, L2, L3, the control circuit 380 first preheats the filaments of the lamps by driving the FETs 252, 254 of the inverter 150 at a high frequency (e.g., approximately 100 kHz). This causes a large voltage to develop across the resonant inductor 462, while a smaller voltage, which is not great enough to strike the lamps L1, L2, L3, develops across the resonant capacitor 494. At this time, the control circuit 380 drives the FET 492 to be non-conductive, such that the filament voltages are provided to the filaments of the lamps L1, L2, L3.

After a predetermined period of time, the control circuit 380 reduces the operating frequency of the FETs 252, 254 to close to the resonant frequency of the output circuit 360 (e.g., 70 kHz), which increases the voltage across the resonant capacitor 464 to strike the lamps L1, L2, L3. Since a voltage is still produced across the resonant inductor 462, the filament voltages will continue to be provided to the lamps. After the lamps L1, L2, L3 are operating normally, the control circuit 380 is operable to cause the FET 492 to conduct, which removes (or reduces) the filament voltages from the filaments of the lamps.

Further, the control circuit 380 is operable to drive the FET 492 with a pulse-width modulated (PWM) signal in order to obtain different magnitudes of the filament voltages on the filament windings W1, W2, W3, W4. This allows the control circuit 380 to reduce magnitude of the filament voltages—and the power consumption of the ballast—without completely removing the filament voltages from the filaments of the lamps. For example, when dimming a lamp to the midpoint of the dimming range, some heating of the filaments is required. However, at this point, it may not be necessary to provide the maximum filament voltage to the filaments, so a filament voltage having a magnitude less than the maximum filament voltage may be provided to the filaments.

The magnitude of a filament voltage is dependent on the duty cycle of the PWM signal, e.g., inversely proportional to the duty cycle. The control circuit 380 is operable to control the duty cycle of the PWM signal in order to vary the magnitude of the filament voltage between the maximum filament voltage (typically about 3-5 $V_{RMS}$) and zero volts. The frequency of the PWM signal is preferably about 25 kHz, which is above the audible frequency range. However, the frequency of the PWM signal is not limited to 25 kHz, but may range up to or greater than the operating frequency of the back end 320 of the ballast 300.

Accordingly, the magnitudes of the filament voltages can be controlled throughout the dimming range of the ballast 300. FIG. 5D shows a plot of the magnitude of the filament voltage versus the dimming level of the ballast, which demonstrates a possible control scheme for controlling the filament voltage. The magnitude of the filament voltage is held constant at five volts when the dimming level is below a first threshold $TH_1$ (e.g., 30% in FIG. 5D) and is held constant at zero when the dimming level is above a second threshold $TH_2$ (e.g., 80% in FIG. 5D). Between the first and second thresholds, the magnitude of the filament voltage is linearly changed from approximately five volts to approximately zero volts. However, the present invention is not limited to using a linear function. Alternatively, a piece-wise step function or a complex curve may be used to decrease the magnitude of the filament voltage as the dimming level increases.

Figure 5E:
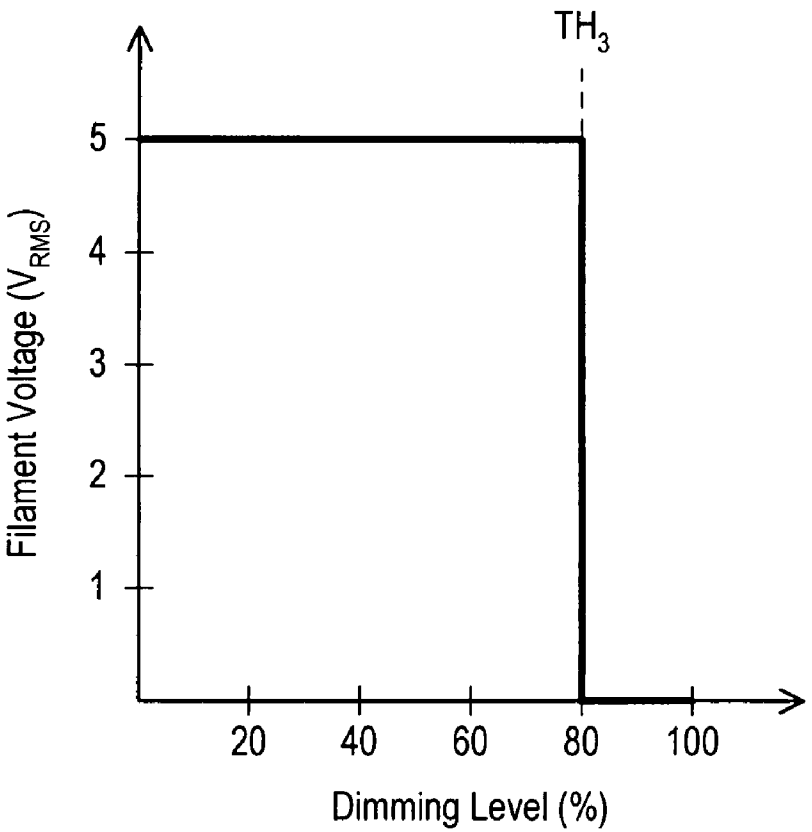
FIG. 5E is a plot of the magnitude of the filament voltage versus the dimming level of the ballast demonstrating a simple control scheme for controlling the filament turn-off circuit of FIG. 4.
Figure 5D:
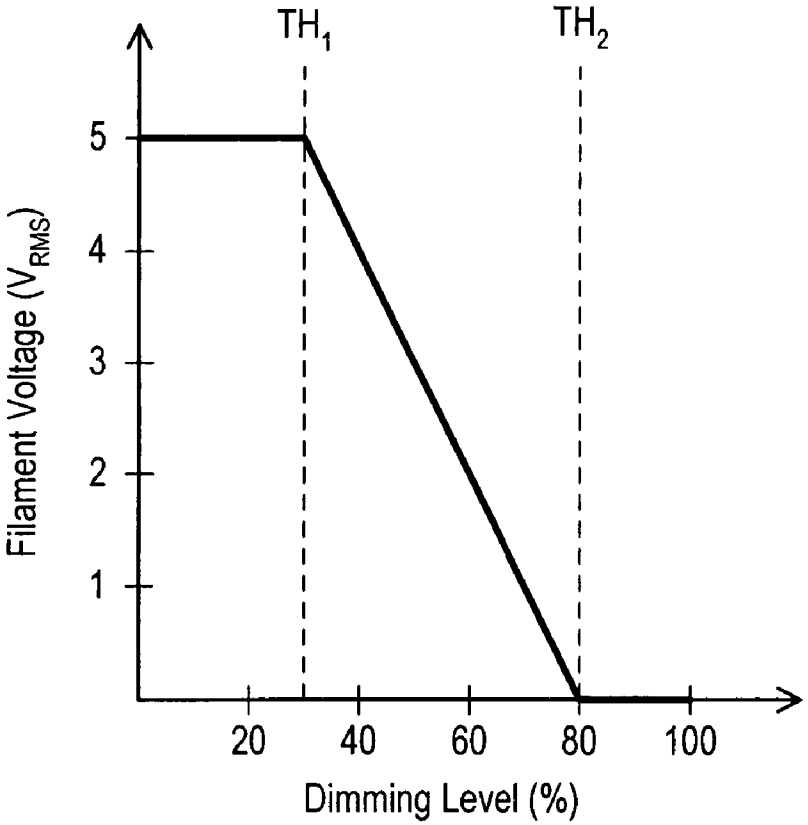
FIG. 5D is a plot of the magnitude of the filament voltage versus the dimming level of the ballast demonstrating a control scheme for linearly controlling the filament turn-off circuit of FIG. 4.

FIG. 5E shows a plot of the magnitude of the filament voltage versus the dimming level of the ballast showing a simple control scheme of the filament voltage. The filament voltage is simply turned off near the high end of the dimming range of the ballast. When the dimming level is below a threshold $TH_3$ (e.g., 80% in FIG. 5E), the filament voltages are held constant at an on-magnitude of approximately five volts RMS, and when the dimming level is above the threshold, the filament voltages are held constant at an off-magnitude of approximately zero volts. When the dimming level is changed such that the dimming level crosses the threshold, the magnitude of the filament voltages is stepped from the on-magnitude to the off-magnitude, or vice versa. Preferably, the filament voltages are "faded", i.e., continuously varied over a period of time from the on-magnitude to the off-magnitude (and vice versa), to avoid a step response of the lamp current through the lamps, which can cause a visible flickering of the lamps. The fading occurs over an appropriate amount of time that allows a control loop of the control circuit to properly regulate the current to the lighting load without causing a visible flickering. For example, if the control loop has a response time of 2 msec, the fading preferably occurs over a time period of about 500 msec.

Figure 6:
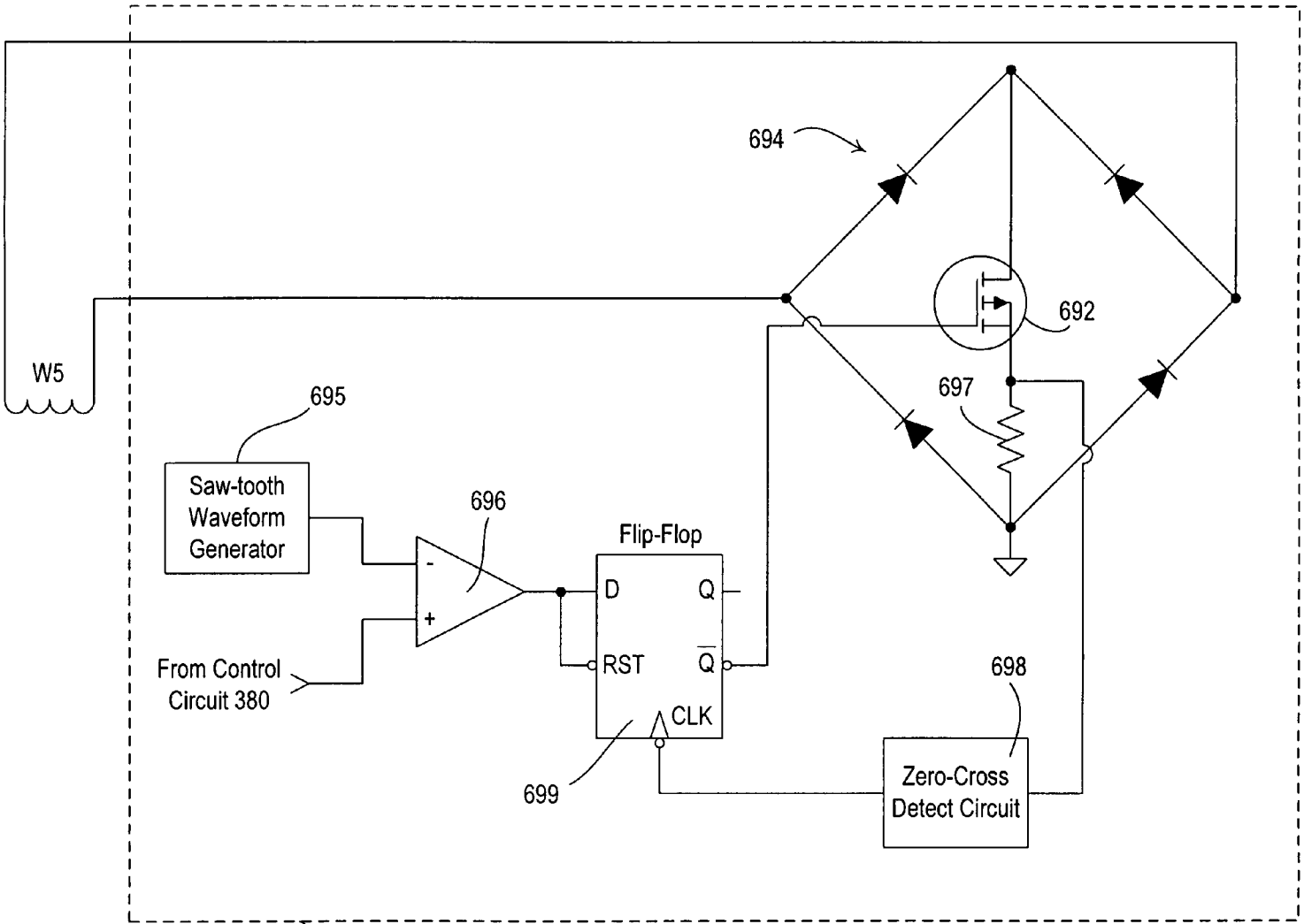
FIG. 6 is a simplified schematic diagram of a filament turn-off circuit according to a second embodiment of the present invention.
Figure 7:
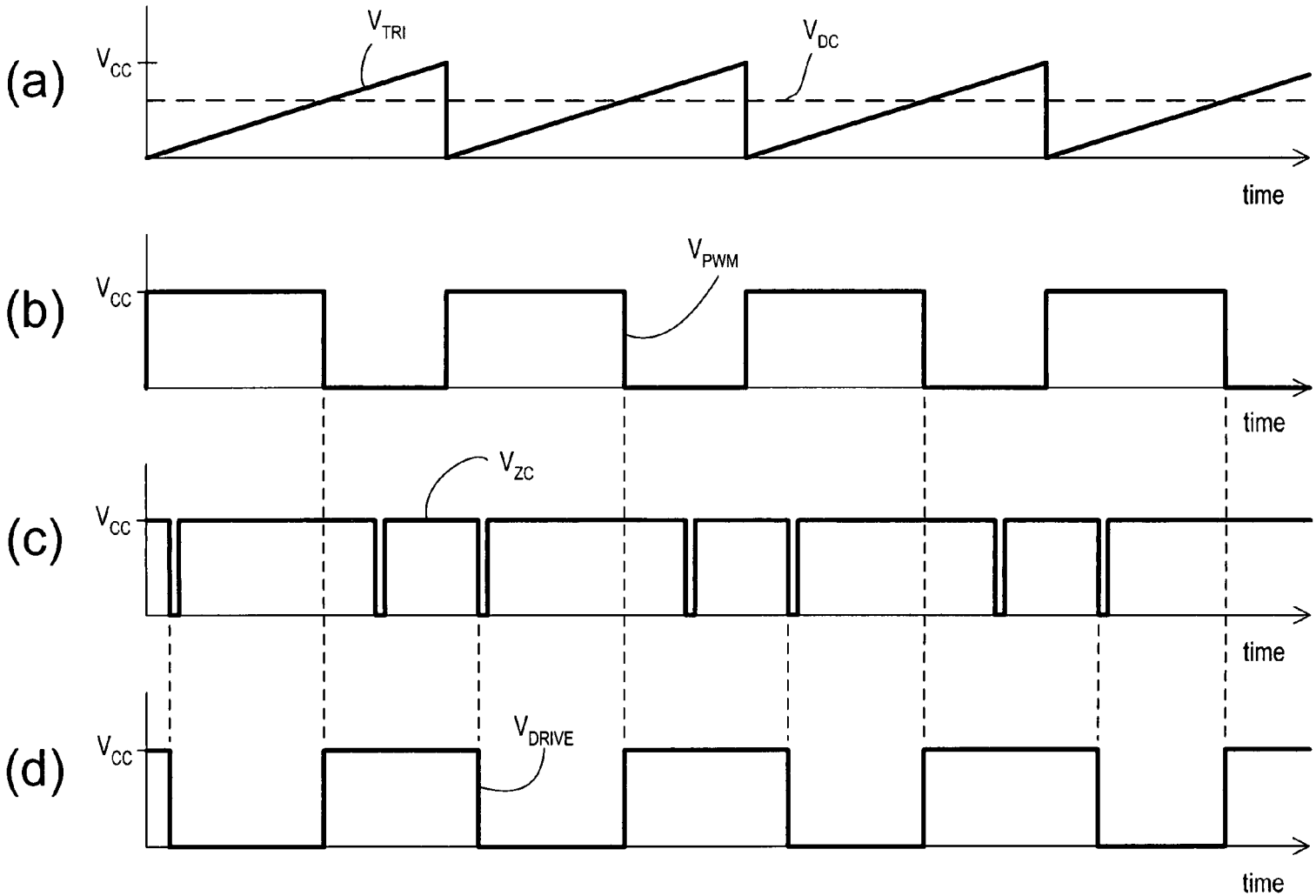
FIG. 7 is a simplified plot of various voltage waveforms of the filament turn-off circuit of FIG. 6.

FIG. 6 shows a simplified schematic diagram of a filament turn-off circuit 690 according to a second embodiment of the present invention. Once again, the filament turn-off circuit 690 is coupled across the additional winding W5 of the output circuit 360 and is operable to control the voltage across the control winding to substantially zero volts. The filament turn-off circuit 690 comprises a FET 692 in a rectifier bridge 694. A saw-tooth waveform generator 695 produces a triangle wave $V_{TR1}$ at the frequency of the PWM signal, i.e., preferably 25 kHz, as shown in FIG. 7(*a*). For this embodiment, the control circuit 380 is operable to provide a DC control voltage $V_{DC}$, shown in FIG. 7(*a*), to the filament turn-off circuit 690. The triangle wave $V_{TR1}$ is provided to the negative input of a comparator 696 and the DC control voltage $V_{DC}$ is provided to the positive input. When the triangle wave $V_{TR1}$ is less than the DC control voltage $V_{DC}$, the output of the comparator 696 will be pulled "high", i.e. to approximately the magnitude of the DC supply voltage $V_{CC}$ of the power supply 182. When the triangle wave $V_{TR1}$ is greater than the DC control voltage $V_{DC}$, the output of the comparator 696 will be pulled "low", i.e., to approximately zero volts. Thus, the comparator 696 generates a PWM signal $V_{PWM}$, shown in FIG. 7(*b*), which has a duty cycle that is dependent on the magnitude of the DC control voltage $V_{DC}$.

Accordingly, the comparator 696 is operable to drive the FET 692 with the PWM signal $V_{PWM}$ in response to the DC control voltage $V_{DC}$. However, the frequency of the PWM signal (e.g., 25 kHz) and the frequency of the current that flows through the FET 692 when the FET is conductive (e.g., 70 kHz during normal operation of the ballast 300) are typically not the same. Therefore, when the PWM signal transitions from high to low, the current through the FET 692 is most likely not near zero amps. It is not desirable to cause the FET 692 to stop conducting when current through the FET has a substantially large magnitude, since this can cause large voltage spikes across the control winding W5 and damage the FET 692 and the filaments of the lamps L1, L2, L3.

Thus, the filament turn-off circuit 690 comprises additional circuitry to cause the FET 692 to stop conducting when the current through the FET is substantially zero amps. A resistor 697 is coupled in series with the FET 692 in the rectifier bridge 694. A zero-cross detect circuit 698 is coupled to the resistor 697 and is operable to determine when the voltage across the resistor 697 is substantially zero volts, i.e., when the current through the FET 692 is substantially zero amps. The zero-cross detect circuit 698 provides a zero-cross signal, $V_{ZC}$, shown in FIG. 7(*c*), which has negative pulses that correspond to the zero-crossings of the current through the FET 692.

The output of the comparator 696, i.e., the PWM signal $V_{PWM}$, is provided to the active-high data input D and the active-low reset input RST of a flip-flop 699. The zero-cross signal $V_{ZC}$ is provided to the active-low clock input CLK of the flip-flop 699. A FET drive signal $V_{DRIVE}$, shown in FIG. 6(*d*), is produced at the negative output $\overline{Q}$ of the flip-flop 699 and is coupled to the gate of the FET 692. When the reset input RST is low, the flip-flop 699 will provide a high voltage at the negative output $\overline{Q}$. For the flip-flop 699 to drive the negative output $\overline{Q}$ low, both the data input D and the reset input RST must be high when the clock input CLK receives a high-to-low transition. Thus, after the PWM signal $V_{PWM}$ transitions from low to high, the flip-flop 699 "holds" the negative output $\overline{Q}$ high until a negative pulse occurs on the zero-cross waveform $V_{ZC}$. When a negative pulse occurs on the zero-cross waveform $V_{ZC}$, the flip-flop 699 drives the negative output $\overline{Q}$ low. Hence, the FET drive signal $V_{DRIVE}$ does not transition from high to low, i.e., does not cause the FET to stop conducting, until the current through the FET 692 is substantially zero amps.

Figure 8:
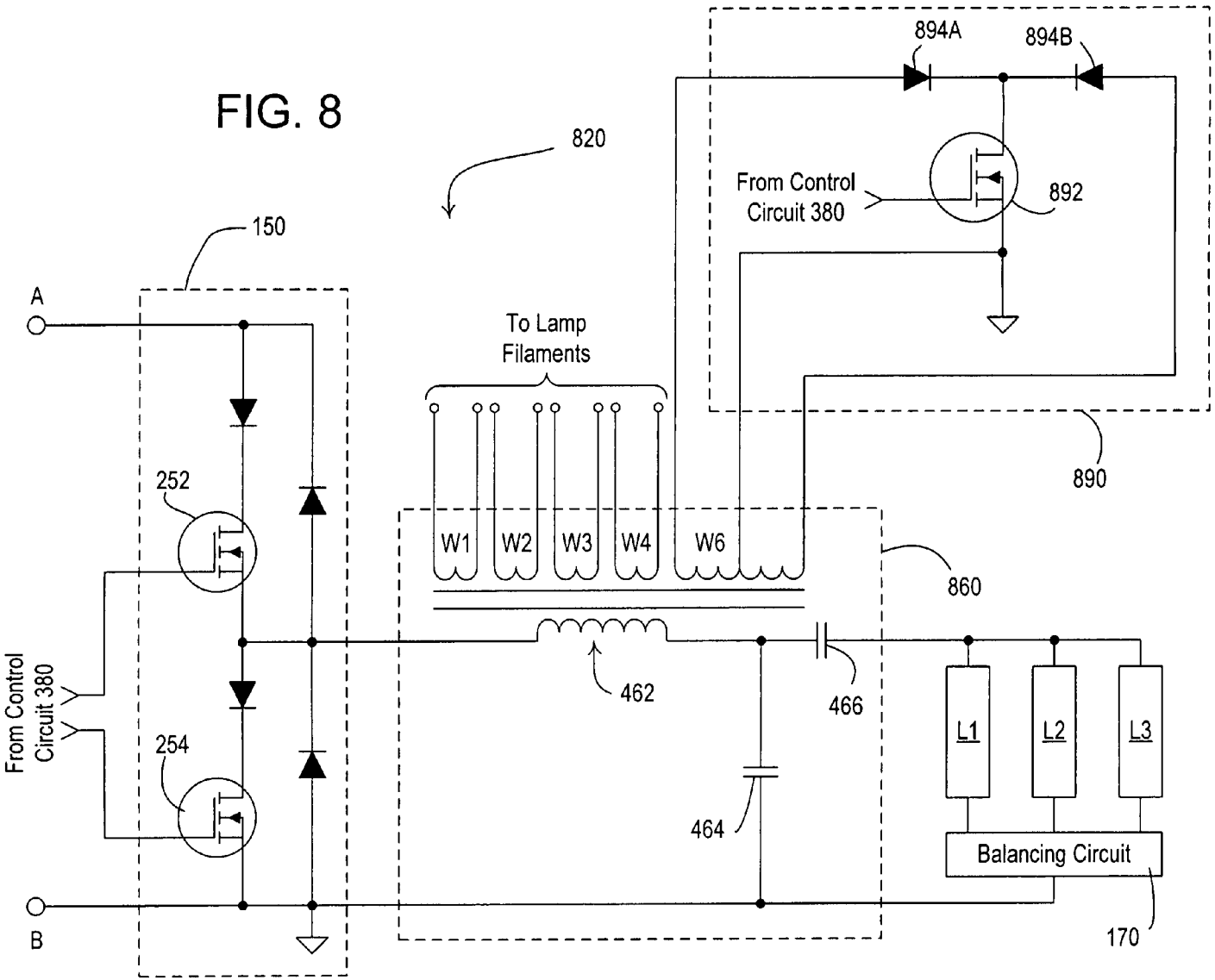
FIG. 8 is a simplified schematic diagram a ballast back end comprising a filament turn-off circuit according to a third embodiment of the present invention.

FIG. 8 shows a simplified schematic diagram of a back end 820 according to a third embodiment of the present invention. An output circuit 860 includes a tapped winding W6, which is coupled to a filament voltage turn-off circuit 890. The filament voltage turn-off circuit 890 comprises a FET 892 having a drain terminal coupled to circuit common and the tap of the tapped winding W6 and a source terminal coupled a first end of the tapped winding through a first diode 894A and to a second end of the tapped winding through a second diode 894B. The control input of the FET 892 is coupled to the control circuit 380. When the FET 892 is non-conductive, the filament windings W1, W2, W3, W4 operate normally and provide the filament voltages to the filaments of the lamps L1, L2, L3. When the FET 892 is conductive, a current flows through the first end of the tapped winding and the first diode 894A during the positive half-cycles, and through the second end of the tapped winding and a second diode 894B during the negative half-cycles. The total resulting voltage across the tapped winding, i.e., from the first end to the second end, is substantially zero volts. Accordingly, when the FET 892 is conductive, the filament voltages across the windings W1, W2, W3, W4 are substantially zero volts.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electronic ballast for driving a gas discharge lamp having a plurality of lamp filaments, the ballast comprising:

an output circuit operable to receive a high-frequency AC voltage and comprising an inductor;

a plurality of filament windings magnetically coupled to the inductor, each of the plurality of filament windings connectable to at least one of the plurality of filaments of the lamp and operable to supply an AC filament voltage to one of the plurality of filaments;

a control winding magnetically coupled to the inductor;

a controllably conductive device having a control input and first and second terminals coupled such that the controllably conductive device is operable to control a voltage across the control winding; and a control circuit coupled to the control input of the controllably conductive device to selectively render the controllably conductive device to be conductive and to be non-conductive;

wherein when the controllably conductive device is non-conductive, each of the plurality of AC filament voltages has a first magnitude, and when the controllably conductive device is conductive, each of the plurality of AC filament voltages has a second magnitude, the control circuit operable to render the controllably conductive device to be non-conductive when an intensity of the lamp is below a predetermined threshold and to render the controllably conductive device to be conductive when the intensity of the lamp is above the predetermined threshold.

2. The ballast of claim 1, wherein the controllably conductive device is operable to control the voltage across the control winding to approximately zero volts.

3. The ballast of claim 2, wherein the controllably conductive device is coupled across the control winding.

4. The ballast of claim 3, wherein the controllably conductive device comprises a bidirectional semiconductor switch.

5. The ballast of claim 4, wherein the bidirectional semiconductor switch comprises a field-effect transistor and a full wave rectifier bridge having a pair of AC terminals connected across the control winding and pair of DC terminals connected across the field-effect transistor.

6. The ballast of claim 5, wherein the field-effect transistor is rendered non-conductive when the current through the field-effect transistor is approximately zero amps.

7. The ballast of claim 4, wherein the bidirectional semiconductor switch comprises two field-effect transistors in anti-series connection.

8. The ballast of claim 2, wherein the control winding comprises a tapped winding having a first end, a second end, and a tap between the first and second ends, and the controllably conductive device comprises a semiconductor switch coupled such that when the semiconductor switch is conductive, a first current flows through the first end during the positive half-cycles of the high-frequency AC voltage, and a second current flows through the second end during the negative half-cycles of the high-frequency AC voltage.

9. The ballast of claim 8, wherein the semiconductor switch has a first terminal and a second terminal, the second terminal coupled to the tap, and the controllably conductive device further comprises a first diode connected in series electrical connection between the first end of the tapped winding and the first terminal of the semiconductor switch, and a second diode connected in series electrical connection between the second end of the tapped winding and the first terminal of the semiconductor switch, the diodes connected such that current flows in only one direction through the semiconductor switch.

10. The ballast of claim 9, wherein the semiconductor switch comprises a field-effect transistor.

11. The ballast of claim 1, wherein the second magnitude is less than the first magnitude.

12. The ballast of claim 11, wherein the second magnitude is approximately zero volts.

13. The ballast of claim 1, wherein the control circuit is operable to drive the controllably conductive device with a pulse-width modulated signal having a variable duty cycle to control the magnitudes of the plurality of AC filament voltages;

wherein the control circuit is operable to fade the magnitude of the plurality of filament voltages from an on-magnitude to an off-magnitude when the intensity of the lamp becomes less than a predetermined threshold, and to fade the magnitude of the plurality of filament voltages from the off-magnitude to the on-magnitude when the intensity of the lamp becomes greater than approximately the predetermined threshold.

14. The ballast of claim 1, wherein the control circuit is operable to render the controllably conductive device conductive when an intensity of the lamp is at or near high end.

15. The ballast of claim 1, wherein the control circuit is operable to render the controllably conductive device non-conductive during preheat.

16. An electronic ballast for driving a gas discharge lamp having a plurality of lamp filaments, the ballast comprising:

an output circuit operable to receive a high-frequency AC voltage and comprising an inductor;

a plurality of filament windings magnetically coupled to the inductor, each of the plurality of filament windings connectable to at least one of the plurality of filaments of the lamp and operable to supply an AC filament voltage to one of the plurality of filaments;

a control winding magnetically coupled to the inductor;

a controllably conductive device having a control input and first and second terminals coupled such that the controllably conductive device is operable to control a voltage across the control winding; and a control circuit coupled to the control input of the controllably conductive device to selectively render the controllably conductive device conductive and non-conductive, such that when the controllably conductive device is non-conductive, each of the plurality of AC filament voltages has a first magnitude, and when the controllably conductive device is conductive, each of the plurality of AC filament voltages has a second magnitude, the control circuit further operable to drive the controllably conductive device with a pulse-width modulated signal having a variable duty cycle, such that the magnitude of each of the plurality of AC filament voltages is variable dependent on the duty cycle of the pulse-width modulated signal;

wherein the control circuit is operable to render the controllably conductive device to be non-conductive when an intensity of the lamp is below a first predetermined threshold, to render the controllably conductive device to be conductive when the intensity of the lamp is above a second predetermined threshold, and to drive the controllably conductive device with the pulse-width modulated signal between the first predetermined threshold and the second predetermined threshold in order to vary the magnitudes of the plurality of filament voltages in dependence on the intensity of the lamp.

17. The ballast of claim 16, wherein the magnitudes of the plurality of filament voltages are varied linearly with respect to an intensity of the lamp.

18. The ballast of claim 16, wherein the controllably conductive device is operable to control the voltage across the control winding to approximately zero volts.

19. The ballast of claim 16, wherein the second magnitude is less than the first magnitude.

20. The ballast of claim 19, wherein the second magnitude is approximately zero volts.

21. An electronic ballast for driving a gas discharge lamp having a plurality of lamp filaments, the ballast comprising:

an output circuit operable to receive a high-frequency AC voltage and comprising an inductor;

a plurality of filament windings each connectable to one of the plurality of filaments of the lamp and each operable to supply an AC filament voltage to one of the plurality of filaments;

a filament turn-off circuit operable to control a magnitude of each of the plurality of AC filament voltages, the filament turn-off circuit comprising a control winding magnetically coupled to the inductor and to the plurality of filament windings, and a controllably conductive device having a control input, the controllably conductive device connected in series electrical connection with the control winding such that when the controllably conductive device is conductive, the plurality of AC filament voltages are approximately zero volts; and a control circuit operable to drive the filament turn-off circuit with a pulse-width modulated signal having a variable duty cycle to control the magnitude of each of the plurality of AC filament voltages;

wherein the control input of the controllably conductive device is coupled to the control circuit such that the control circuit is operable to drive the controllably conductive device with the pulse-width modulated signal.

22. The ballast of claim 20, wherein the control circuit is operable to render the controllably conductive device non-conductive when an intensity of the lamp is below a first predetermined threshold, to render the controllably conductive device conductive when the intensity of the lamp is above a second predetermined threshold, and to drive the controllably conductive device with the pulse-width modulated signal between the first predetermined threshold and the second predetermined threshold in order to vary the magnitudes of the plurality of filament voltages with respect to the intensity of the lamp.

23. The ballast of claim 22, wherein the magnitudes of the plurality of filament voltages are varied linearly with respect to the intensity of the lamp.

24. The ballast of claim 21, wherein the control circuit is operable to render the controllably conductive device to be non-conductive when an intensity of the lamp is below a predetermined threshold and to render the controllably conductive device to be conductive when the intensity of the lamp is above the predetermined threshold.

25. The ballast of claim 24, wherein the control circuit is operable to fade the magnitude of the plurality of filament voltages when the intensity of the lamp transitions across the predetermined threshold.

26. A circuit for an electronic ballast for controlling a plurality of AC filament voltages provided to a plurality of filaments of a gas discharge lamp, the circuit comprising:

a plurality of filament windings magnetically coupled to an inductor of an output circuit of the ballast, the plurality of filament windings each connectable to one of the plurality of filaments of the lamp and each operable to provide one of the plurality of AC filament voltages to one of the plurality of filaments;

a control winding magnetically coupled to the inductor;

a controllably conductive device having a control input and first and second terminals coupled such that the controllably conductive device is operable to control a voltage across the control winding; and a control circuit coupled to the control input of the controllably conductive device to render the controllably conductive device to be conductive and to be non-conductive;

wherein when the controllably conductive device is non-conductive, each of the plurality of AC filament voltages has a first magnitude, and when the controllably conductive device is conductive, each of the plurality of AC filament voltages has a second magnitude, the controllably conductive device operable to control the voltage across the control winding to approximately zero volts when an intensity of the lamp is above a predetermined threshold.

27. The circuit of claim 26, wherein the controllably conductive device is coupled across the control winding.

28. The circuit of claim 27, wherein the controllably conductive device comprises a bidirectional semiconductor switch.

29. The circuit of claim 28, wherein the bidirectional semiconductor switch comprises a field-effect transistor and a full wave rectifier bridge having a pair of AC terminals connected across the control winding and pair of DC terminals connected across the field-effect transistor.

30. The circuit of claim 29, wherein the field-effect transistor is rendered non-conductive only when the current through the field-effect transistor is approximately zero amps.

31. The circuit of claim 28, wherein the bidirectional semiconductor switch comprises two field-effect transistors in anti-series connection.

32. The circuit of claim 26, wherein the control winding comprises a tapped winding having a first end, a second end, and a tap between the first and second ends, and the controllably conductive device comprises a semiconductor switch coupled such that when the semiconductor switch is conductive, a first current flows through the first end during the positive half-cycles and a second current flows through the second end during the negative half-cycles.

33. The circuit of claim 32, wherein the semiconductor switch has a first terminal and a second terminal, the second terminal coupled to the tap, and the controllably conductive device further comprises a first diode connected in series electrical connection between the first end of the tapped winding and the first terminal of the semiconductor switch, and a second diode connected in series electrical connection between the second end of the tapped winding and the first terminal of the semiconductor switch.

34. The circuit of claim 33, wherein the semiconductor switch comprises a field-effect transistor.

35. The circuit of claim 26, wherein the control circuit is operable to drive the controllably conductive device with a pulse-width modulated signal having a variable duty cycle;

wherein a magnitude of each of the plurality of AC filament voltages is variable dependent on the duty cycle of the pulse-width modulated signal.

36. circuit of claim 35, wherein the control circuit is operable to render the controllably conductive device to be non-conductive when an intensity of the lamp is below a first predetermined threshold, to render the controllably conductive device to be conductive when the intensity of the lamp is above a second predetermined threshold, and to drive the controllably conductive device with the pulse-width modulated signal when the intensity of the lamp is between the first predetermined threshold and the second predetermined threshold in order to vary the magnitudes of the plurality of filament voltages with respect to the intensity of the lamp.

37. The circuit of claim 36, wherein the magnitudes of the plurality of filament voltages are varied linearly with respect to an intensity of the lamp when the intensity of the lamp is between the first predetermined threshold and the second predetermined threshold.

38. A method for controlling a plurality of AC filament voltages provided to a plurality of filaments of a gas discharge lamp in an electronic ballast comprising an output circuit including an inductor; the method comprising the steps of:

magnetically coupling a plurality of filament windings to the inductor, connecting each of the filaments of the lamp to one of the plurality of filament winding;

providing each of the plurality of filaments with one of the plurality of AC filament voltages;

magnetically coupling a control winding to the inductor; and controlling a voltage across the control winding to control a magnitude of each of the plurality of AC filament voltages provided to the filaments;

wherein the step of controlling a voltage across the control winding comprises:

coupling a controllably conductive device having a control input across the control winding such that the controllably conductive device is operable to control the voltage across the control winding;

controlling the controllably conductive device such that when the controllably conductive device is non-conductive, each of the plurality of AC filament voltages has a first magnitude, and when the controllably conductive device is conductive, each of the plurality of AC filament voltages has a second magnitude; and controlling the voltage across the control winding to approximately zero volts when an intensity of the lamp is above a predetermined threshold.

39. The method of claim 38, wherein the step of coupling a controllably conductive device comprises coupling the controllably conductive device across the control winding.

40. The method of claim 39, wherein the controllably conductive device comprises a bidirectional semiconductor switch.

41. The method of claim 40, wherein the bidirectional semiconductor switch comprises a field-effect transistor and a full wave rectifier bridge having a pair of AC terminals connected across the control winding and pair of DC terminals connected across the field-effect transistor.

42. The ballast of claim 41, wherein the field-effect transistor is rendered non-conductive only when the current through the field-effect transistor is approximately zero amps.

43. The method of claim 40, wherein the bidirectional semiconductor switch comprises two field-effect transistors in anti-series connection.

44. The method of claim 38, wherein the control winding comprises a tapped winding having a first end, a second end, and a tap between the first and second ends, and the controllably conductive device comprises a semiconductor switch coupled such that when the semiconductor switch is conductive, a first current flows through the first end during the positive half-cycles of the AC filament voltages, and a second current flows through the second end during the negative half-cycles of the AC filament voltages.

45. The method of claim 44, wherein the semiconductor switch has a first terminal and a second terminal, the second terminal coupled to the tap, and the controllably conductive device further comprises a first diode connected in series electrical connection between the first end of the tapped winding and the first terminal of the semiconductor switch, and a second diode connected in series electrical connection between the second end of the tapped winding and the first terminal of the semiconductor switch.

46. The method of claim 45, wherein the semiconductor switch comprises a field-effect transistor FET.

47. The method of claim 38, wherein the step of controlling the controllably conductive device comprises driving the controllably conductive device with a pulse-width modulated signal to control the magnitude of each of the plurality of AC filament voltages.

48. The method of claim 47, wherein the step of controlling the controllably conductive device further comprises the steps of:

rendering the controllably conductive device non-conductive when an intensity of the lamp is below a first predetermined threshold;

rendering the controllably conductive device conductive when the intensity of the lamp is above a second predetermined threshold; and driving the controllably conductive device with the pulse-width modulated signal when the intensity of the lamp is between the first predetermined threshold and the second predetermined threshold in order to vary the magnitudes of the plurality of filament voltages with respect to the intensity of the lamp.

49. The method of claim 48, wherein the magnitudes of the plurality of filament voltages are varied linearly with respect to the intensity of the lamp when the intensity of the lamp is between the first predetermine threshold and the second predetermined threshold.

50. The method of claim 38, wherein the step of controlling the controllably conductive device comprises the steps of:

rendering the controllably conductive device to be non-conductive when an intensity of the lamp is below a predetermined threshold; and rendering the controllably conductive device to be conductive when the intensity of the lamp is above the predetermined threshold.

51. The method of claim 50, wherein the step of controlling the controllably conductive device further comprises driving the controllably conductive device with a pulse-width modulated signal having a variable duty cycle when the intensity of the lamp transitions across the predetermined threshold to fade the magnitude of the plurality of filament voltages.

52. The method of claim 38, wherein the second magnitude is less than the first magnitude.

53. The method of claim 52, wherein the second magnitude is approximately zero volts.

54. The method of claim 38, wherein the step of controlling the controllably conductive device comprises rendering the controllably conductive device conductive when an intensity of the lamp is at or near high end.

55. The method of claim 38, wherein the step of controlling the controllably conductive device comprises rendering the controllably conductive device non-conductive during preheat.

56. A method for controlling a plurality of AC filament voltages provided to a plurality of filaments of a gas discharge lamp in an electronic ballast comprising an output circuit including an inductor and a plurality of filament windings, the method comprising the steps of:

connecting each of the plurality of filaments of the lamp to one of the plurality of filament windings;

magnetically coupling the plurality of filament windings to the inductor;

providing each of the plurality of lamp filaments with one of the plurality of AC filament voltages;

magnetically coupling a control winding to the inductor;

coupling a filament turn-off circuit comprising a controllably conductive device to the output circuit;

coupling the controllably conductive device such that the controllably conductive is operable to control a voltage across the control winding; and driving the controllably conductive device with a pulse-width modulated signal to control the magnitude of each of the plurality of AC filament voltages.

57. The method of claim 56, further comprising the steps of:

magnetically coupling a control winding to the inductor and to the plurality of filament windings; and coupling the controllably conductive switch in series electrical connection with the control winding such that when the controllably conductive device is conductive, the magnitudes of the plurality of AC filament voltages are approximately zero volts.

58. The method of claim 57, wherein the step of driving the controllably conductive device comprises the steps of:

rendering the controllably conductive device to be non-conductive when an intensity of the lamp is below a first predetermined threshold;

rendering the controllably conductive device to be conductive when the intensity of the lamp is above a second predetermined threshold; and driving the controllably conductive device with the pulse-width modulated signal when the intensity of the lamp is between the first predetermined threshold and the second predetermined threshold in order to vary the magnitudes of the plurality of filament voltages with respect to the intensity of the lamp.

59. The method of claim 58, wherein the magnitudes of the plurality of filament voltages are varied linearly with respect to the intensity of the lamp.

60. The method of claim 57, wherein the step of driving the controllably conductive device further comprises the steps of:

fading the magnitude of the plurality of filament voltages from an on-magnitude to an off-magnitude by driving the controllably conductive device with the pulse-width modulated signal when the intensity of the lamp becomes less than a predetermined threshold; and subsequently rendering the controllably conductive device non-conductive.

61. The method of claim 60, wherein the step of driving the controllably conductive device further comprises the steps of:

fading the magnitude of the plurality of filament voltages from the off-magnitude to the on-magnitude by driving the controllably conductive device with the pulse-width modulated signal when the intensity of the lamp becomes greater than approximately the predetermined threshold; and subsequently rendering the controllably conductive device conductive.

62. The method of claim 57, wherein the step of driving the controllably conductive device further comprises the steps of:

rendering the controllably conductive device to be non-conductive when the intensity of the lamp is below a predetermined threshold; and rendering the controllably conductive device to be conductive when the intensity of the lamp is above the predetermined threshold.

* * * * *